US007246691B2

(12) United States Patent
Lindauer et al.

(10) Patent No.: US 7,246,691 B2
(45) Date of Patent: Jul. 24, 2007

(54) FLUID FRICTION CLUTCH FOR A MOTOR VEHICLE FAN

(75) Inventors: Kuno Lindauer, Mühlacker (DE); Gerold Schultheiss, Pforzheim (DE); Rudolf Stoklossa, Mühlacker (DE)

(73) Assignee: Behr GmbH & Co. KG, Stuttgart (DE)

( * ) Notice: Subject to any disclaimer, the term of this patent is extended or adjusted under 35 U.S.C. 154(b) by 101 days.

(21) Appl. No.: 11/061,685

(22) Filed: Feb. 18, 2005

(65) Prior Publication Data

US 2005/0189194 A1 Sep. 1, 2005

(30) Foreign Application Priority Data

Feb. 20, 2004 (DE) ..... 10 2004 008 861

(51) Int. Cl.
*F16D 35/02* (2006.01)
*F04D 29/58* (2006.01)

(52) U.S. Cl. ..... 192/58.61; 416/169 A

(58) Field of Classification Search ..... 192/58.61, 192/58.8

See application file for complete search history.

(56) References Cited

U.S. PATENT DOCUMENTS

| | | | | |
|---|---|---|---|---|
| 3,749,214 | A * | 7/1973 | Leichliter | 192/58.4 |
| 3,893,555 | A | 7/1975 | Elmer | |
| 4,850,465 | A * | 7/1989 | Ono | 192/58.682 |
| 5,330,040 | A | 7/1994 | Drennen | |
| 5,358,382 | A * | 10/1994 | Muhlbach | 416/169 A |
| 6,010,305 | A * | 1/2000 | Hauser | 416/169 A |
| 6,032,775 | A | 3/2000 | Martin | |
| 6,056,098 | A * | 5/2000 | Brown et al. | 192/58.61 |
| 6,206,639 | B1 * | 3/2001 | Light et al. | 416/169 A |
| 6,443,283 | B1 * | 9/2002 | Augenstein et al. | 192/58.61 |
| 2004/0168877 | A1 | 9/2004 | Drager et al. | |

FOREIGN PATENT DOCUMENTS

| | | | |
|---|---|---|---|
| DE | 1 158 769 | | 12/1963 |
| DE | 2 361 481 | | 6/1974 |
| DE | 2 414 017 | | 12/1974 |
| DE | 7 321 965 | U | 8/1976 |
| DE | 197 42 823 | A1 | 4/1999 |
| DE | 103 38 432 | A1 | 3/2004 |
| EP | 350585 | A1 * | 1/1990 |
| EP | 407749 | A1 * | 1/1991 |
| EP | 0 540 006 | A2 | 5/1993 |
| EP | 1 031 751 | A1 | 8/2000 |
| GB | 1 401 069 | | 7/1975 |
| GB | 2 163 835 | A | 3/1986 |

* cited by examiner

*Primary Examiner*—Richard M. Lorence
(74) *Attorney, Agent, or Firm*—Foley & Lardner LLP

(57) ABSTRACT

A fluid friction clutch for a motor vehicle fan comprises at least one rotatably mounted shaft, a drive element firmly mounted on the shaft so as to rotate with it and a driven element rotatably mounted about the axis of the shaft. The drive element and driven element form a coupling region, which accommodates a viscous fluid. A fan member is connected to the outer region of the driven element by means of at least one partially plastic or plastic-encapsulated fixing ring arranged concentrically with respect to the axis of rotation.

17 Claims, 8 Drawing Sheets

FLUID FRICTION CLUTCH FOR A MOTOR VEHICLE FAN

CROSS-REFERENCE TO RELATED PATENT APPLICATIONS

The right of priority under 35 U.S.C. §119(a) is claimed based on Federal Republic of Germany Patent Application 10 2004 008 861.6, filed Feb. 20, 2004, the entire disclosure of which, including the specification, drawings, claims and abstract, is incorporated herein by reference.

BACKGROUND OF THE INVENTION

The present invention relates to a fluid friction clutch or drive that is especially suitable for driving a motor vehicle fan.

Such fluid friction clutches are known in the prior art and are used for radiator fans or as drives per se, in order to permit sufficient dissipation of heat from the thermal energy generated by an internal combustion engine, for example. Such fan clutches are used in particular for vehicles in the medium power range, such as transporters, off-road vehicles, lightweight goods vehicles and agrarian applications.

In addition to electrically actuated fan clutches, use is also made of thermally actuated fluid friction clutches which have a bimetallic valve and which have storage chambers or reservoirs only on the secondary side. However, this design has control problems at low rotational speed and in the case of rapid engagement of the clutch and/or its starting characteristics. In particular, this is disadvantageous in the case of vehicles with gasoline engines in which the ratio between nominal rotational speed and idling speed of the motor assumes relatively high values.

Furthermore, so-called "fan boom" or "morning sickness" problems are known. These are caused in particular by the fact that the transmission region of the clutch is relatively highly filled with oil when the engine is idling (fan boom) or when the engine is cold started (morning sickness) and, as a result of relatively high engine rotational speeds and the associated fan clutch engagement, the fan causes unnecessary and/or unpleasant fan noise.

SUMMARY OF THE INVENTION

It is one object of the present invention to provide an improved fan clutch, in particular, one that permits of more economical production.

A further object of the invention is to provide an improved motor vehicle in which the cooling fan is driven with a fan clutch according to the invention.

According to one aspect of the present invention there has been provided a fluid friction clutch suitable for driving a motor vehicle fan, comprising: a rotatably mounted shaft; a drive element fixedly mounted on the shaft so as to rotate with it; a driven element rotatably mounted about the shaft to form a coupling region between the drive and driven elements for accommodating a viscous fluid; and a fan member connected to the outer region of the driven element by means of a fixing element, the fixing element comprising at least in part a plastic material or being at least partly encapsulated in a plastic material.

In accordance with another aspect of the invention, there is provided an apparatus for operating a cooling system for a motor vehicle, which comprises at least one fan and a drive unit for the fan, wherein the drive unit comprises at least one fluid friction clutch as described above.

Further objects, features and advantages of the present invention will become apparent from the detailed description of preferred embodiments that follows, when considered together with the accompanying figures of drawing.

DETAILED DESCRIPTION OF PREFERRED EMBODIMENTS

Figure 1A:
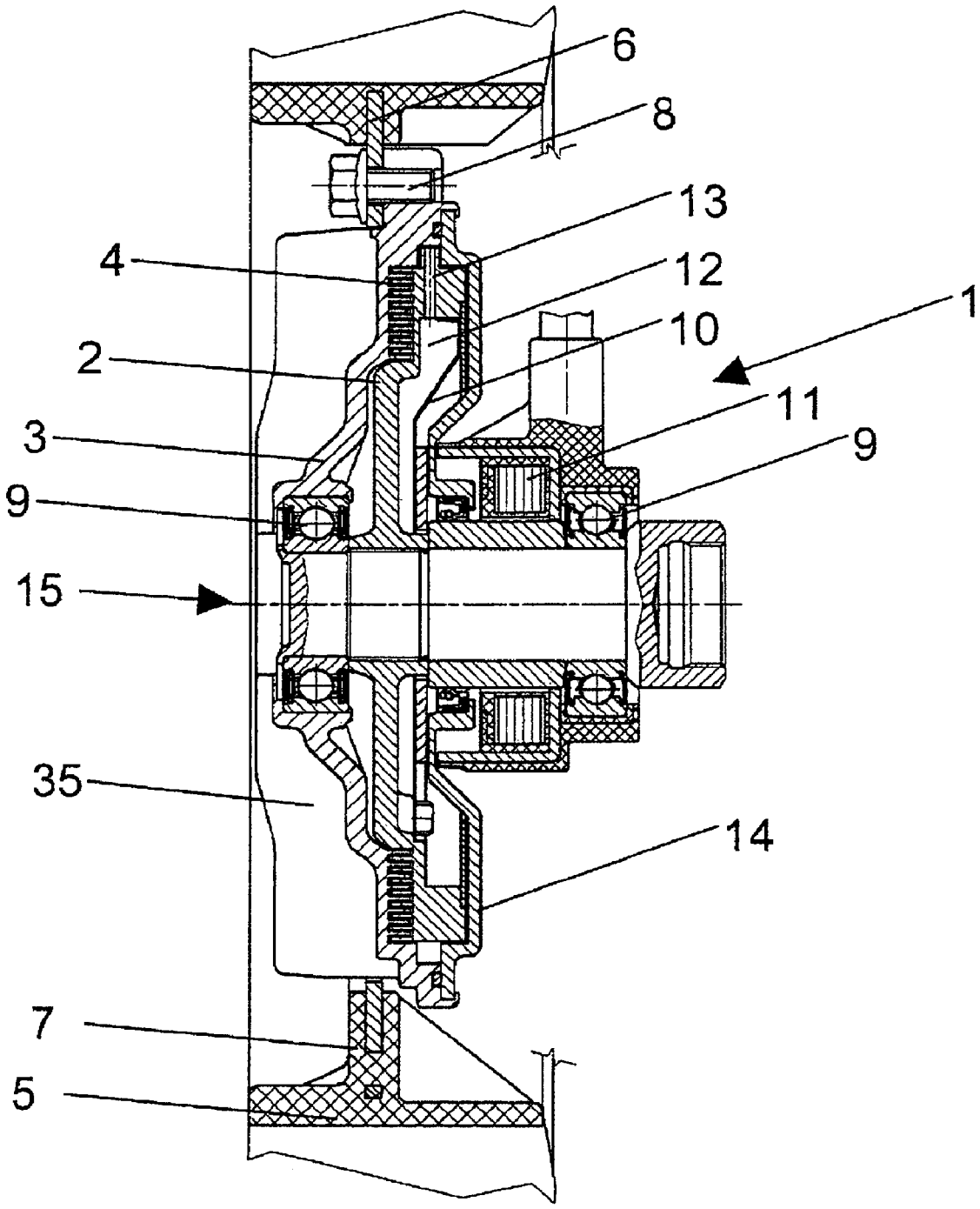
FIG. 1*a* is a cross-sectional illustration showing a fluid friction clutch according to the invention.

The fluid friction clutch or drive according to the invention, which is suitable for driving a motor vehicle fan, has at least one rotatably mounted shaft, on which there are arranged at least one drive element firmly mounted so as to rotate with it and at least one rotatably mounted driven element. Between the drive and driven elements, a coupling region is provided, which accommodates a viscous fluid and in this way is able to transmit a torque between the drive element and the driven element. In the fluid friction clutch a fan and/or at least the fan blades thereof is/are connected to the outer region of the driven element by means of at least one fixing ring, in particular at least one fixing ring consisting partly of plastic or partly encapsulated in plastic, which is concentric with the axis of rotation.

According to the present invention, the drive elements of the fluid friction clutch according to the invention are understood to mean at least partly profiled disks, which are mounted on the shaft so as to be rotatable or to rotate with said shaft and are used to transmit a predefined torque via a viscous fluid contained between the profiled portions.

Likewise, the driven elements are understood to be at least partly profiled disks, which interact with at least one drive element in such a way that a predefined torque is transmitted directly or indirectly from the drive element to the driven element, by means of the viscous fluid.

According to the present invention, a fixing ring is understood to mean preferably a metal ring, which is connected to at least one predefined region of the driven element and is arranged in a predefined region on the fan or in the region of the fan blades.

The fixing ring is preferably produced from metallic materials but, according to a particularly preferred embodiment, can also be produced from a plastic or a composite material, such as a plastic-carbon fiber composite material or the like.

According to a particularly preferred embodiment, the fluid friction clutch has at least a first and at least a second flow path, which connect at least one fluid storage chamber to at least one coupling region. Furthermore, at least one control device is provided, with which at least one flow path, but in particular both flow paths, is/are opened and closed.

According to the present invention, flow paths are understood to mean regions of the fluid friction clutch through which the viscous fluid can flow.

According to a further particularly preferred embodiment, at least one flow path extends in the radial direction within the drive element to such an extent that the mouth of the flow path opens in the fluid storage chamber of the fluid friction clutch, above the fluid level. According to a particularly preferred embodiment, the fluid storage chamber is understood to mean the chamber within the fluid friction clutch which is located radially within the flow path which is provided for the inflow of the viscous fluid into the coupling region and which, in the axial direction, is covered both by at least one of the drive and/or driven elements and within the housing of the fluid friction clutch.

According to a further particularly preferred embodiment, the hub of the fan is formed in part by the at least partly plastic-encapsulated fixing ring.

According to the present invention, plastic encapsulation is understood to mean a coating which is selected from a group of materials which comprises varnishes, natural or artificial plastic resins, combinations thereof and the like.

According to a particularly preferred embodiment, the fixing ring has openings which are arranged on a predefined radius with respect to the axis of rotation. According to a further particularly preferred embodiment, these openings have no plastic encapsulation in a predefined region or in the openings themselves, and may optionally have applied a corrosion prevention layer in these regions.

According to a preferred embodiment, the fluid friction clutch has a central connection accessible from the front side.

According to the present invention, the front side is understood to mean the side of the fluid friction clutch against which, for example, the airflow of the fan or the wind due to travel of a motor vehicle flows, in particular flows frontally. This can be, for example, the front, which is oriented toward a radiator of the vehicle.

According to a further particularly preferred embodiment, ribs, in particular cooling ribs or fins, are arranged on the side of the driven element facing the front. According to a particularly preferred embodiment, these ribs extend radially inwardly from the radially outer regions of the drive element, with the region of the central connection itself being devoid of ribs, in particular in the embodiment having a central connection. The same is also correspondingly true of the regions of the fixing ring with which the latter is connected to the driven element.

According to a preferred embodiment of the fluid friction clutch, the fixing ring is connected to the driven element by a type of connection which is selected from a group which comprises force-fitting, form-fitting and/or material connections, such as rough connections, riveted connections, adhesive connections, soldered or welded connections, or combinations thereof and the like.

According to a further preferred embodiment, the fluid friction clutch is arranged as an axial extension of a drive device of a motor vehicle, such as a water pump of a motor vehicle. This can be both a fixed connection and a detachable connection, such as, for example, by means of a central connection which extends in the axial direction in the rotation shaft.

According to a further particularly preferred embodiment, the driven element is supported by means of an output drive-side bearing of the fluid friction clutch and a further bearing which is associated with the drive device.

According to a further particularly preferred embodiment, the fluid friction clutch has control devices for the flow paths which, according to a particularly preferred embodiment, are controllable tilting levers of which the actuating position can preferably be altered by means of an electromagnetic actuator.

The electromagnetic actuator has, for example, one or more magnetic coils which, according to a particularly preferred embodiment, are arranged in the region of the bearings of the rotating axles and/or directly in the region of the housing of the drive device.

According to a particularly preferred embodiment, the magnetic flux of the electromagnetic actuator is effected at least via a ferromagnetic hub and/or axle of the clutch, for example, of an adjacent component. Furthermore, the magnetic flux is effected via at least one ferromagnetic component which is preferably a sleeve inserted into a non-ferromagnetic pulley and which itself is produced from ferromagnetic material. The object of this arrangement is to construct a closed ring of the magnetic field, via which the control device(s), such as a tilting lever, can be reliably controlled.

According to a further particularly preferred embodiment, however, the electromagnetic actuator can also be arranged on the front side of the clutch.

According to a further particularly preferred embodiment, the coupling region of the fluid friction clutch has substantially profiled structures in order to transmit a torque, which are arranged concentrically on at least one side of the driven element and drive element, in each case, and which interengage with a predefined spacing.

The invention further comprises an apparatus for operating a cooling system, in particular for a motor vehicle, which comprises at least one fan, a drive unit, a connecting element and at least one fluid friction clutch according to the present invention. The invention also includes a method for using a fluid friction clutch according to the invention for operating a cooling system for a motor vehicle.

Turning now to the drawings, FIG. 1*a* shows a fluid friction clutch 1 according to the invention in a cross-sectional illustration. Arranged to be fixed to the shaft 15 so as to rotate with it is a drive element 2, to whose outer regions a profile 4 is applied. This profile engages in an appropriately mating profile of the driven element 3, which is rotatably mounted on the shaft by means of the bearing 9. The drive element 2 also has a flow path 13, which extends radially from the storage chamber or reservoir 12 in the direction of the radial end of the driven element 3 and has a fluid connection to the coupling region (working gap) between the profiles of the driven element 2 and of the driven element 3. According to the embodiment illustrated here, this flow path is used to supply the viscous fluid into the coupling region. Adjacent to the flow path 13 and positioned in the storage chamber 12, a tilting lever 10 opens or closes the opening at the radially inner end of the flow path 13, depending on its actuating position. Also illustrated is an actuator 11 which, according to the embodiment illustrated here, has a coil which can build up a magnetic field via one or more electric leads.

A ring 6, which represents a fixing device for the fan blades 5, is connected to the driven element 3 by means of one or more fixing screws 8. The ring 6 is preferably metallic whereas the fan blade assembly is preferably made of a plastic material, whereby the metallic ring 6 can advantageously be embedded in the plastic material as a fixing mechanism. In the region of the fixing screw 8, the plastic portion 7 covering the ring 6 is reduced in such a way that the fixing ring 6 preferably rests essentially flatly on or against the driven element 3 and can be connected thereto by means of one or more fixing screws 8. The plastic covering ring 6 preferably consists of the same material from which the fan blades 5 are produced.

In FIG. 1*a* only one fixing screw is illustrated; however, the use of a multiple fixing screws lies within the scope of the present invention.

By means of the illustrated arrangement of the individual elements of the fluid clutch, inter alia, very fast return of the oil from the coupling region into the storage chamber 12 can be achieved. Thus, the negative phenomena known in the prior art, such as "fan boom" and "morning sickness", can be avoided or at least reduced. In particular, the controllable return of the viscous fluid via a flow path means that the action of the return pump (not illustrated in detail) can be increased very sharply, to enable a rapid emptying of the coupling region.

The function and design of such a clutch are described in DE (2002) 102 38 739.7, (corresponding to U.S. 2004/168877), which is incorporated by reference herein, in its entirety.

In order to improve this function of the clutch further, the storage chamber 12 is preferably designed with the largest possible diameter, in order that the back-pressure of the return pump, which depends on centrifugal force, remains as low as possible. This large diameter of the storage chamber 12 can be achieved, for example, by dispensing with the drive element profiling 4 on one side. Furthermore, this design results in the possibility of being able to employ a rear housing cover 14 which can be produced more economically in terms of shaping technology.

Figure 1B:
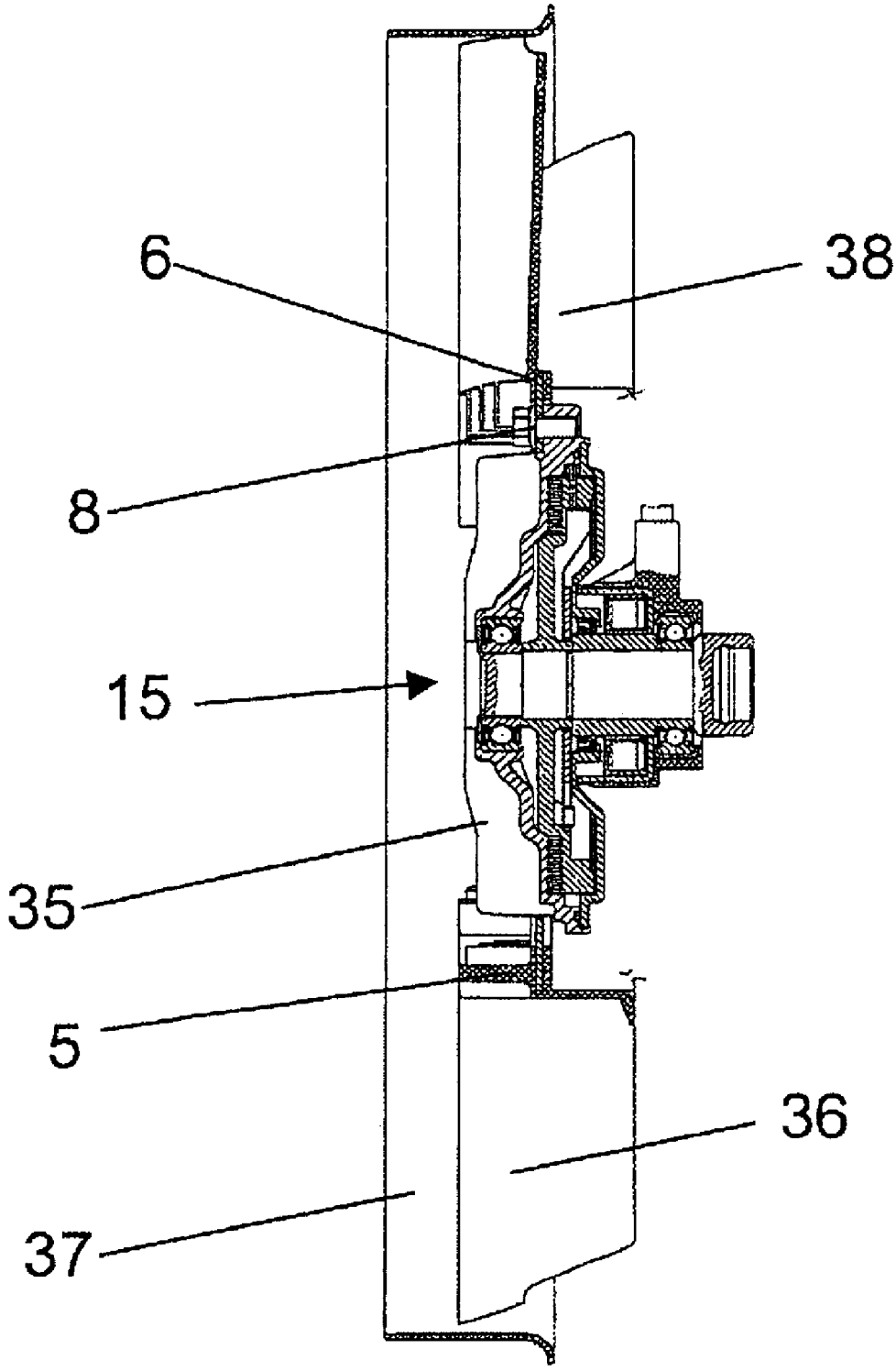
FIG. 1*b* is a cross-sectional illustration showing the clutch according to FIG. 1*a* and a fan impeller.
Figure 1C:
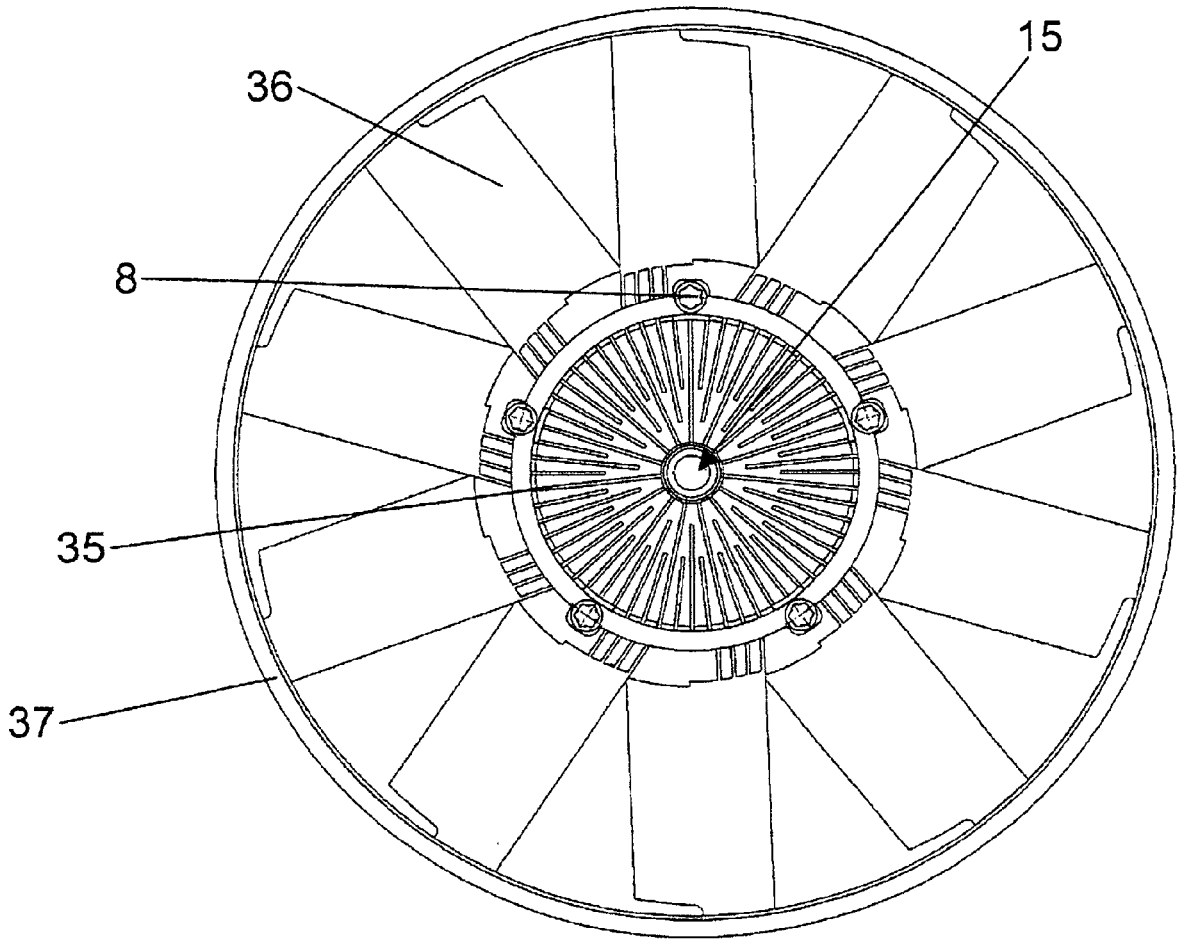
FIG. 1*c* is a plan view illustrating the clutch and the fan impeller according to FIG. 1*b;*

FIGS. 1*b* and 1*c* show the drive from FIG. 1*a* with a circular fan wheel, in a cross section and plan view, respectively.

Here, the fan ring 37, the fan impeller 36, the fixing elements 8 and the cooling ribs of the fan hub 35 are illustrated. Furthermore, the partially plastic-encapsulated fixing ring 6 can also be seen which, according to the exemplary embodiment illustrated here, is a fixing ring with predefined cutouts.

The rotational axle or shaft of the drive is identified by the reference numeral 15.

Figure 2:
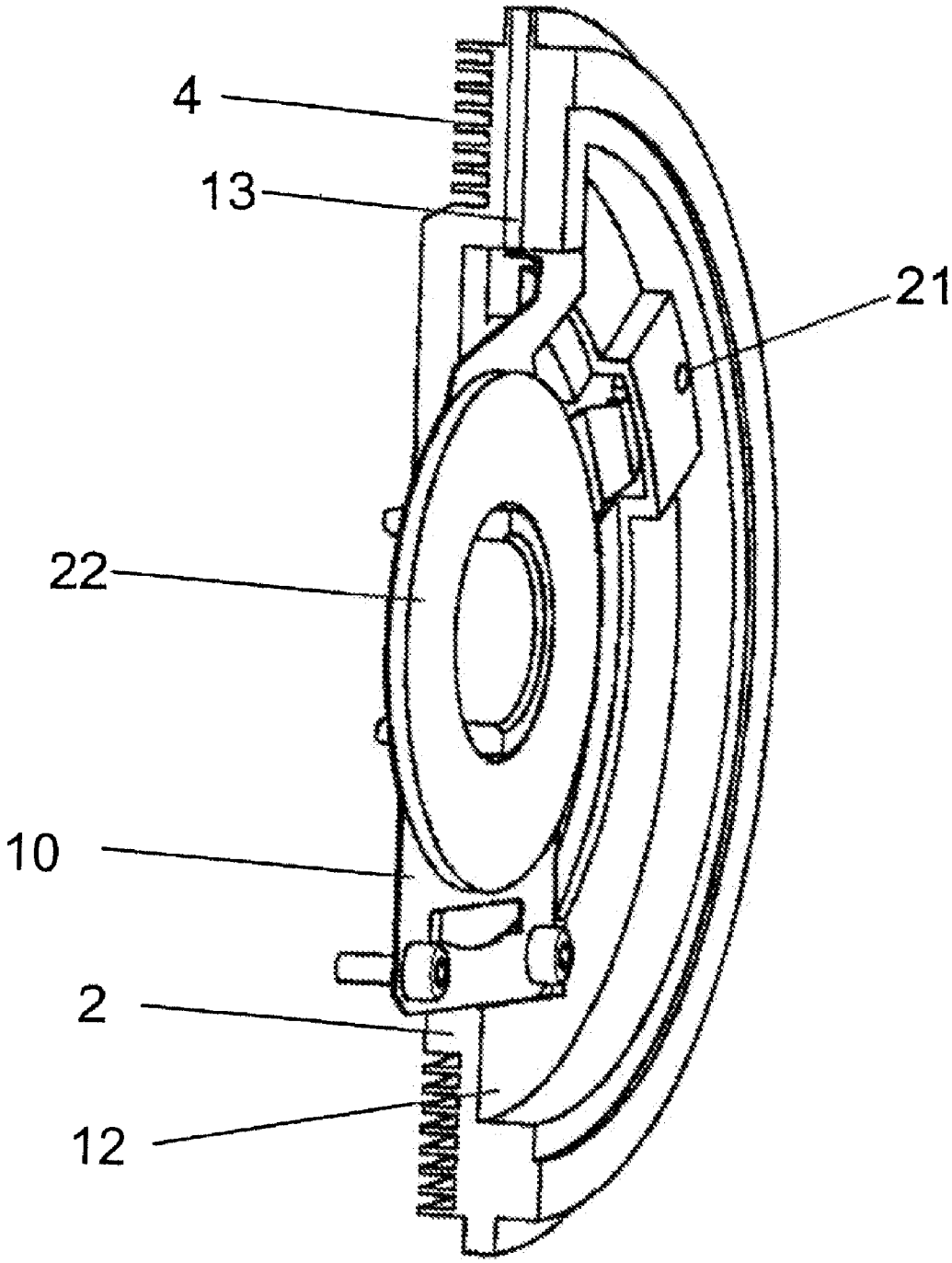
FIG. 2 is a sectioned perspective view illustrating a clutch element having a control device.

FIG. 2 shows a partially sectioned perspective illustration of the drive element 2 with a control device according to FIG. 1*a*. In addition to the drive element 2 and its profiling 4, it is possible to see the flow path 13, the return opening 21 of a further flow path, the structure defining one side of the storage chamber 12, and the valve lever 10. Provided on the valve lever is a magnetic armature 22 which is used to transmit the activating force from the actuator (FIG. 1*a*) to the valve lever.

In order to avoid an undesired rise in the idling speed of the fan when the clutch is disengaged, the return bore 21 can be lengthened radially inwardly to such an extent that the mouth is located above (radially inwardly of) the liquid level in the storage chamber 12. This is particularly important when very high drive speeds are required since, in these situations, the pressure on the fluid as a result of the centrifugal force in the return bore 21 can override the starting pressure of the pump. This can lead to the clutch being unintentionally engaged in some instances.

Moreover, in order to effect an improvement in the dissipation of heat from the fluid friction clutch, attempts are made to provide the largest possible diameter of the front side. In this way, the front-side half of the housing of the fluid friction clutch can effectively be equipped with cooling fins or ribs. On the other hand, an excessively large fan hub would hinder the most uniform possible flow of cooling air through the cooling network of a motor vehicle and would not normally be optimum in this region.

For this reason, according to the exemplary embodiment illustrated here, the screw-fixing region of the fan hub is designed with a relatively large diameter, and the plastic encapsulation is cut out in the connecting region, at least for the fixing screws and their passage openings. In addition to the improved heat transport, the larger diameter of the screw fixing region leads to a reduction in the mechanical stresses on account of the larger lever arm for applying force to the fixing region of the fan.

Figure 3:
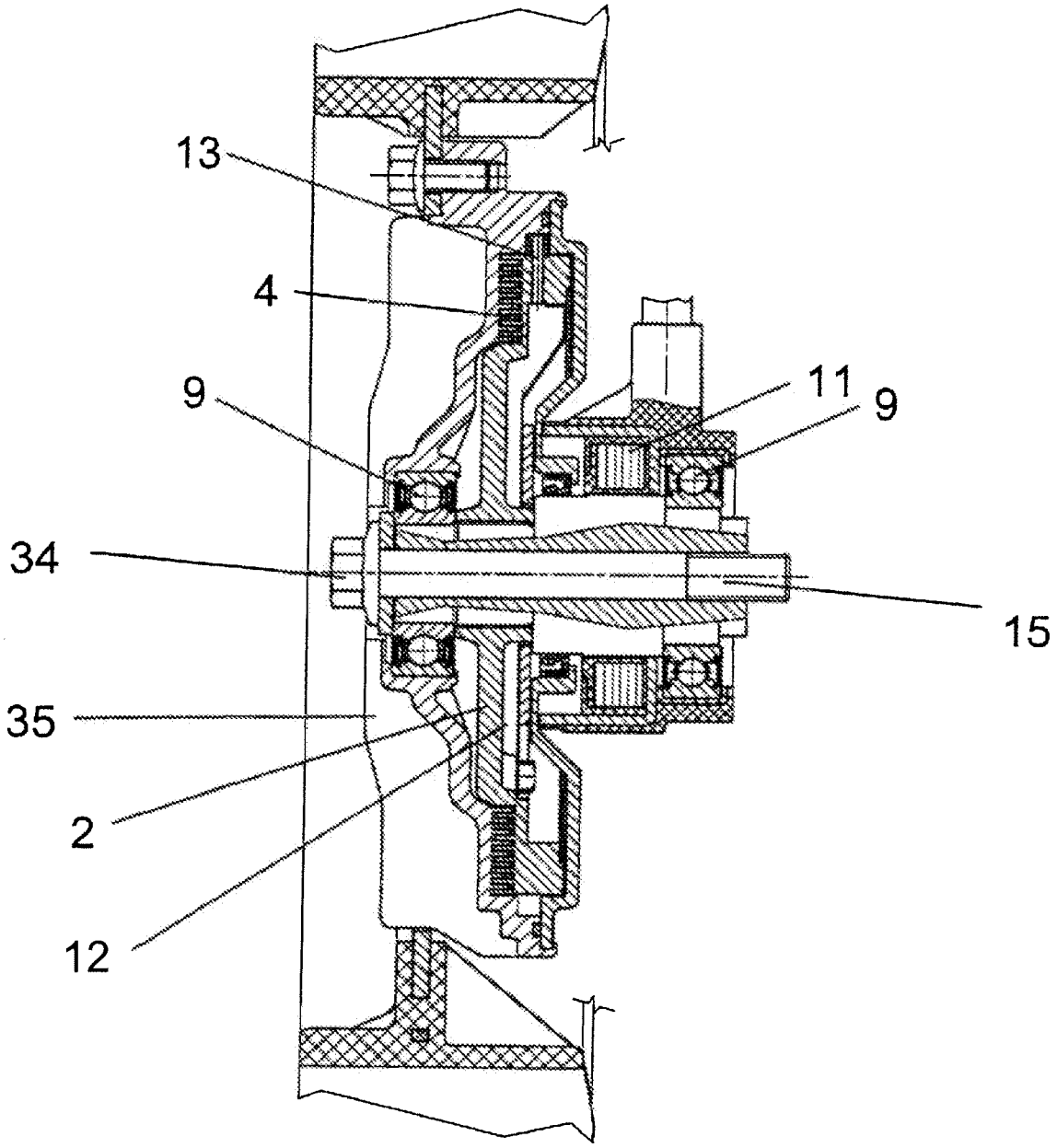
FIG. 3 is a cross-sectional view of an alternative embodiment of a fluid friction clutch of the invention.

FIG. 3 shows an alternative embodiment of a fluid friction clutch according to the invention, in a cross-section wherein a central screw fixing 34 is provided which is accessible from the front side.

Figure 4:
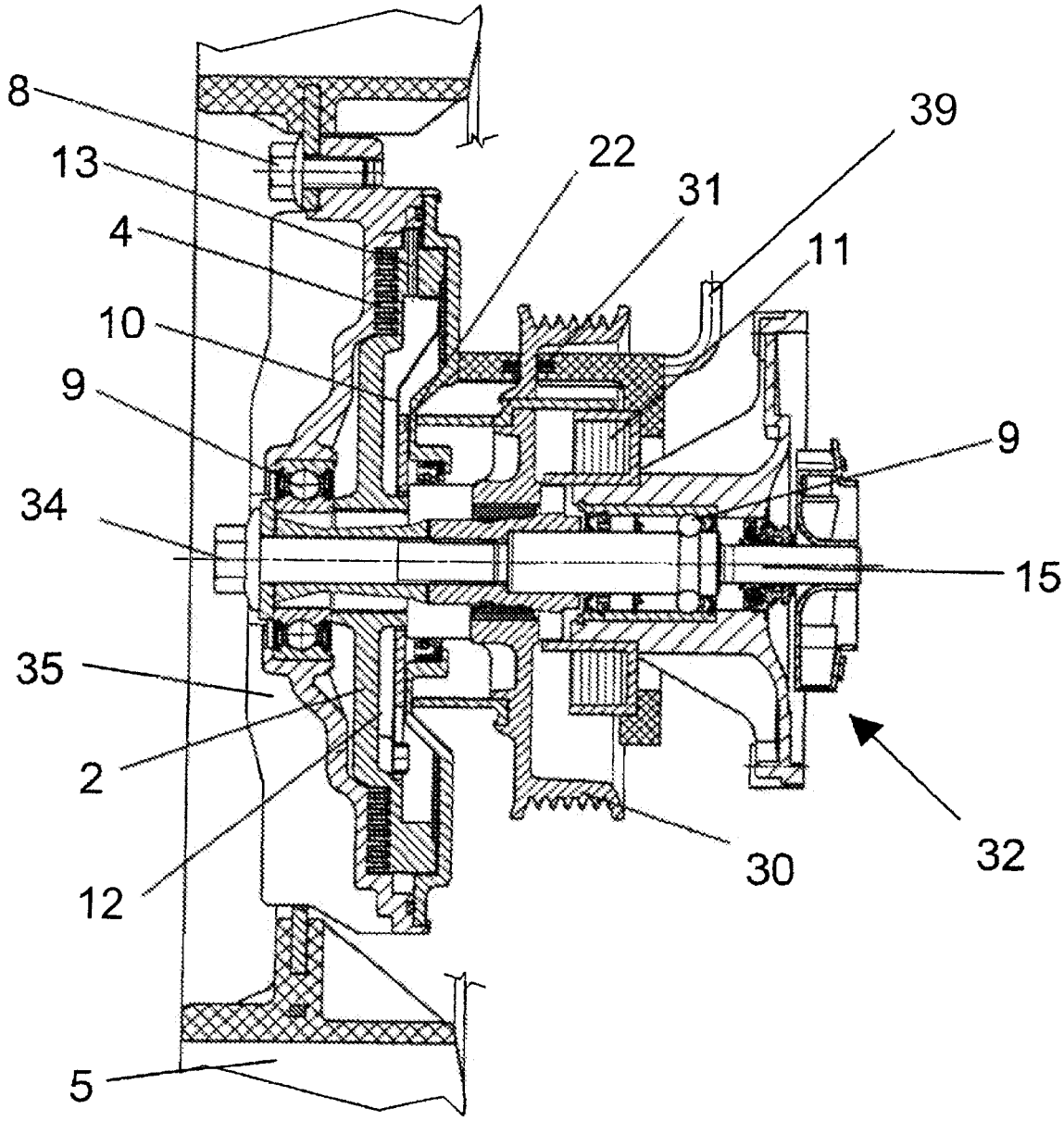
FIG. 4 is a cross-sectional view showing a further alternative embodiment of a fluid friction clutch according to the invention, in combination with parts of a water pump.

FIG. 4 shows an alternative embodiment of a fluid friction clutch according to the invention, in combination with a water pump 32 or parts thereof. In this embodiment, the centrally fastened clutch is mounted by a screw on a water pump in such a way that the shaft 15 for the water pump and also for the fluid friction clutch are both firmly connected so as to rotate together by means of the central fixing 34.

However, it is possible to use other types of connection for the shaft of the water pump and the centrifugal clutch within the scope of the present invention, such as, for example, a one-piece shaft or an interposed gearbox.

The drive according to this alternative embodiment is provided via a pulley 30, which is firmly connected to the shaft 15 so as to rotate with it. According to this exemplary embodiment, the actuator 11 for the actuation of the tilting lever 10 is not located over a ball bearing of the rotating shaft, but is fixed to the housing of the water pump 32. The magnetic flux is led via the steel hub of the pulley 30 to the magnetic armature 22 and effects the change in the position of the tilting lever 10 when the actuator 11 is energized via the electrical lead(s) 39. The magnetic return flux takes place via the steel sleeve 31 inserted into the pulley, in a particularly preferred exemplary embodiment the pulley, which in this case is produced from a non-ferromagnetic, that is to say non-magnetically conducting, material, such as aluminum or alloys thereof or the like.

A further advantage of this alternative embodiment is that the number of bearings needed to operate the water pump and the fluid friction clutch can be reduced so that, as illustrated in FIG. 4, only two bearings 9 are sufficient to mount the components.

As already illustrated in the other figures, the fan blades 5, the cooling ribs 35, the fixing screw 8 and the metal ring 6 can be seen in FIG. 4.

Figure 5:
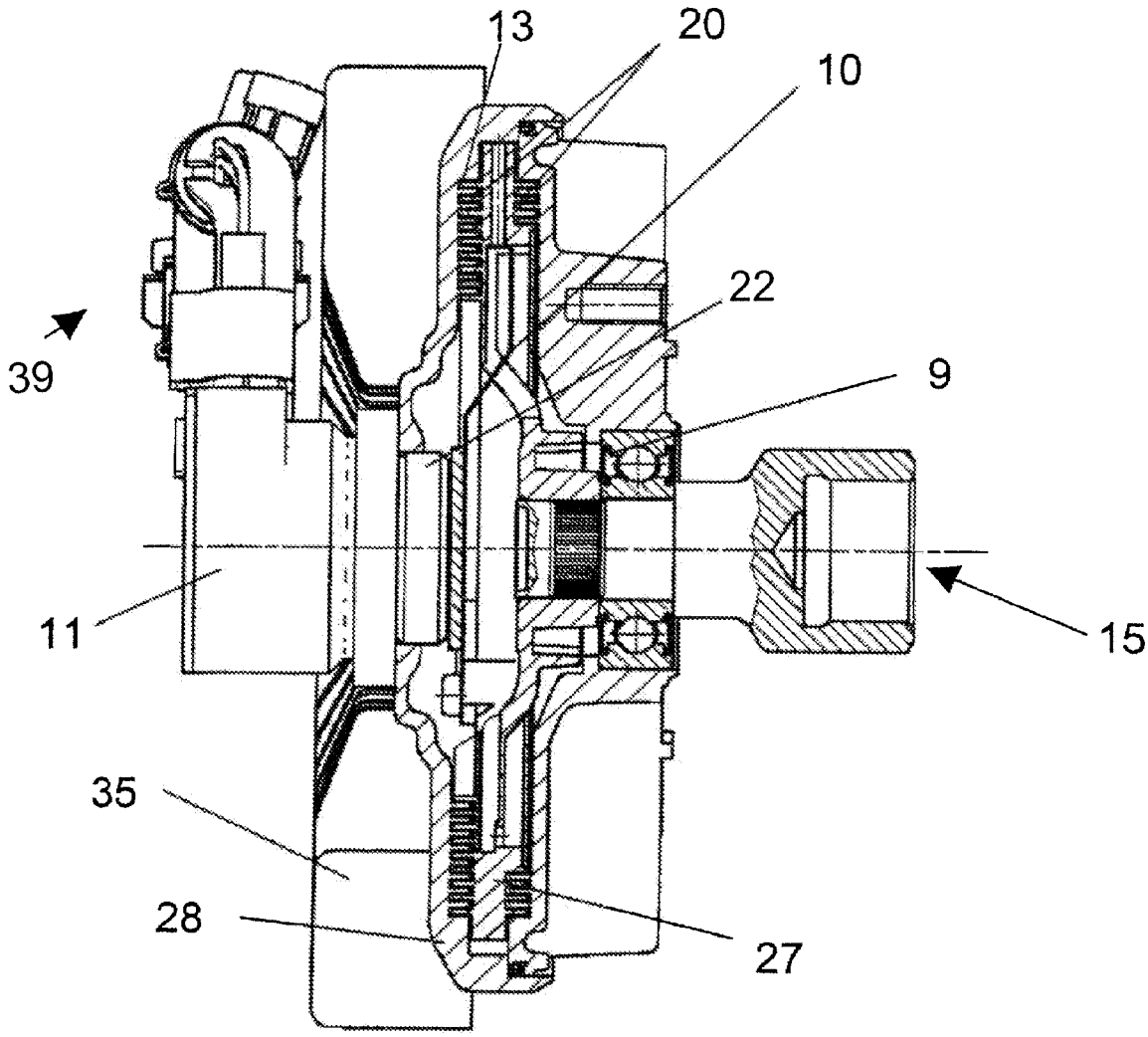
FIG. 5 is a cross-sectional view taken through a further alternative embodiment of a fluid friction clutch according to the invention.
Figure 6:
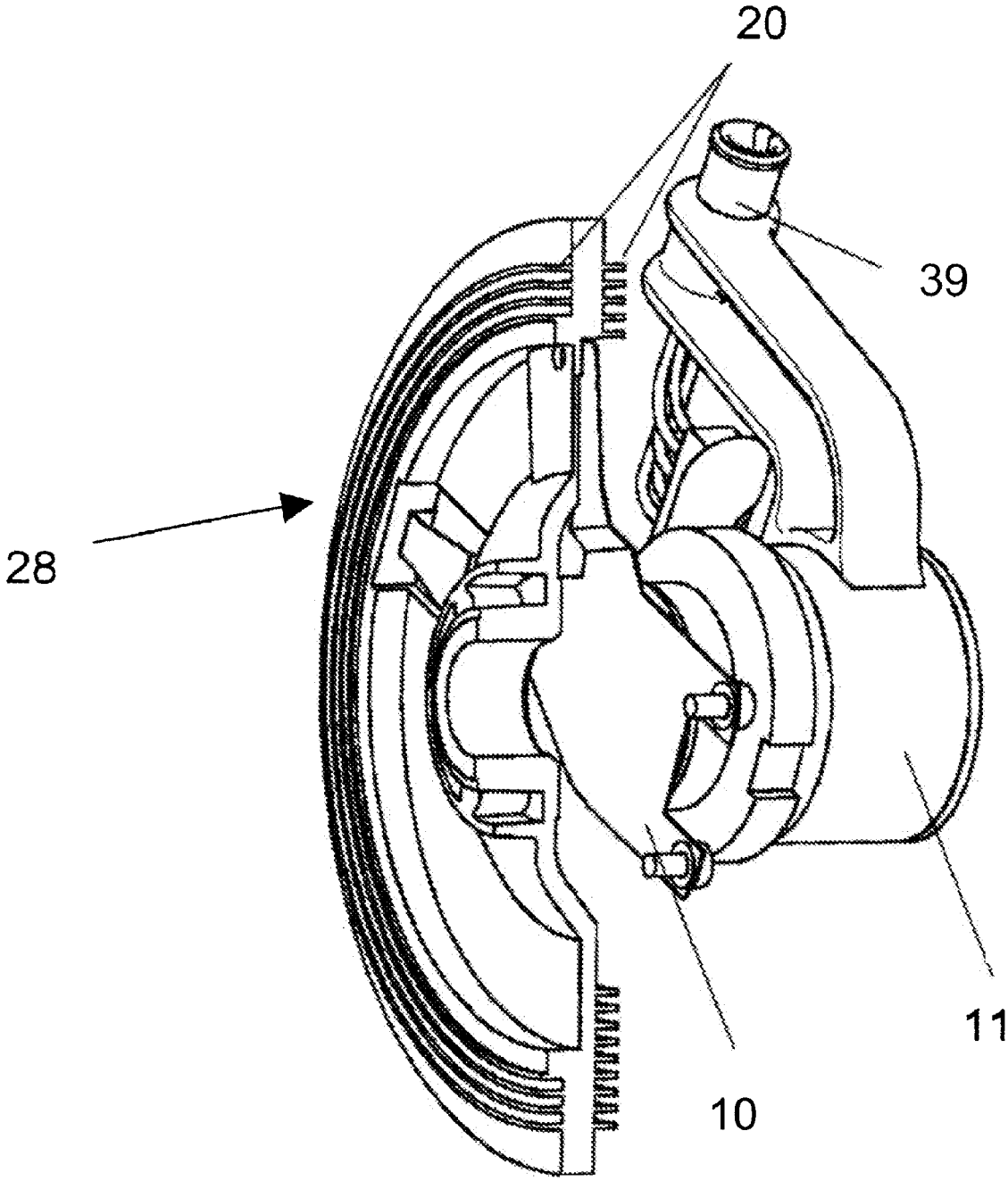
FIG. 6 is a sectioned perspective illustration of a two-sided profiled drive element with control device according to the fluid friction clutch shown in FIG. 5.

FIGS. 5 and 6 show further alternative embodiments of the fluid friction clutch according to the invention, in which, as compared with the fluid friction clutches illustrated previously, the actuator is fitted to the front side of the clutch.

In FIG. 5, the outer housing of the actuator 11 and the electrical lead(s) 39 can be seen in a cross-sectional illustration. The actuator is operatively connected to the tilting lever 10 of the fluid friction clutch through the central cutout portion of the cooling ribs 35.

The housing (formed by driven element 28) terminates the fluid friction clutch toward the front at least in a fluid-tight manner. According to the exemplary embodiment illustrated here, the drive element 27 has a profiled section 20 as a coupling region on both side faces, which engages in correspondingly shaped profiles of the driven element 28. It is possible to also see the flow path 13 and the storage chamber 12 for the viscous fluid. The driven disk 27 is further supported on the shaft 15 by the bearing 9.

FIG. 6 shows a detail of the fluid friction clutch from FIG. 5, illustrating a partially sectioned perspective view of the drive element, including the actuator 11 and its connecting devices 39. It is possible to see the profiled regions of the drive element 27, the valve lever 10 for opening and for closing the flow paths and its arrangement in relation to the actuator.

In this description, the term "plastic" or "plastic material" means any of the natural or more typically synthetic resin materials (e.g., nylon, polyolefin or vinyl aromatic based material) that are conventional in this art.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A fluid friction clutch suitable for a driving motor vehicle fan, comprising:

a rotatably mounted shaft;

a drive element fixedly mounted on the shaft so as to rotate with it;

a driven element rotatably mounted about the axis of the shaft to form a coupling region between the drive element and the driven element for accommodating a viscous fluid;

a fan member connected to an outer region of the driven element by a fixing element, wherein the fixing element comprises an annular ring segment at least partly encapsulated in a plastic material; and a fan head comprising a plastic material, wherein the fan head at least partly encapsulates the ring segment;

wherein the ring segment comprises at least one opening receiving a connecting member for connecting the ring segment to the driven element, wherein the at least one opening is disposed in an annular portion of the ring segment at a position that is at a predefined radial distance such that the at least one opening at least partly overlaps with an area of the fixing element encapsulated by plastic; and wherein a gap in the plastic encapsulation of the fixing element is selectively provided at the at least one opening for accommodating the connecting member.

2. A fluid friction clutch as claimed in claim 1, comprising at least a first and at least a second flow path for fluidly connecting a fluid storage chamber to the coupling region, and at least one control device for selectively opening and closing at least one of the flow paths.

3. A fluid friction clutch in particular as claimed in claim 2, wherein at least one flow path extends in a radial direction within the drive element to such an extent that the flow path opens into the fluid storage chamber radially inwardly of a fluid level in the fluid storage chamber.

4. A fluid friction clutch as claimed in claim 1, wherein the fluid friction clutch has a central connection accessible from a front side of the fluid friction clutch.

5. A fluid friction clutch as claimed in claim 1, wherein the at least one fixing ring segment is connected to the driven element by a type of connection member which is selected from a group consisting of a force-fitting, a form-fitting, and a material connection.

6. A fluid friction clutch as claimed in claim 1, comprising at least one cooling rib on a side of the driven element facing toward a front of the fluid friction clutch.

7. A fluid friction clutch as claimed in claim 1, further comprising a water pump, wherein the clutch is arranged as an axial extension of the water pump.

8. A fluid friction clutch as claimed in claim 7, wherein the clutch is supported in a rotationally movable manner by an output drive-side bearing of the fluid friction clutch and a bearing of the water pump.

9. A fluid friction clutch as claimed in claim 2, wherein the control device comprises at least one tilting lever and an electromagnetic actuator for moving the lever.

10. A fluid friction clutch as claimed in claim 9, wherein the electromagnetic actuator comprises at least one magnetic coil arranged in a region of a rotating axle bearing and/or directly in a region of the drive device.

11. A fluid friction clutch as claimed in claim 2, wherein at least one of a ferromagnetic hub or an axle of the clutch is configured to carry a magnetic flux for an electromagnetic actuator.

12. A fluid friction clutch as claimed in claim 11, wherein a sleeve of ferromagnetic material inserted into a pulley of non-ferromagnetic design is configured to carry the magnetic flux.

13. A fluid friction clutch as claimed in claim 9, wherein the electromagnetic actuator is arranged on a front side of the clutch.

14. A fluid friction clutch as claimed in claim 1, wherein the coupling region is formed substantially by interengaging, concentric profiled structures on at least one side of the driven element and the drive element.

15. An apparatus for operating a cooling system for a motor vehicle, comprising at least one fan and a drive unit for the fan, wherein the drive unit comprises at least one fluid friction clutch as claimed in claim 1.

16. A fluid friction clutch as claimed in claim 1, wherein the at least one fixing ring segment is connected to the driven element by a type of connection member selected from the group consisting of a screw connection, a riveted connection, an adhesive connection, a soldered connection, a welded connection, and a combination thereof.

17. A fluid friction clutch as claimed in claim 16, wherein the connection member comprises a screw connection.

* * * * *